US005653529A

United States Patent [19]

Spocharski

[11] Patent Number: 5,653,529

[45] Date of Patent: Aug. 5, 1997

[54] ILLUMINATED SAFETY DEVICE

[76] Inventor: Frank A. Spocharski, 2021 Roosevelt Blvd., Kenner, La. 70062

[21] Appl. No.: 508,418

[22] Filed: Sep. 14, 1995

[51] Int. Cl.[6] ..... F21L 11/00

[52] U.S. Cl. ..... 362/235; 362/184; 362/191; 362/251; 362/396

[58] Field of Search ..... 362/190, 191, 362/235, 249, 251, 252, 184, 396, 806, 185; 24/16 PB

[56] References Cited

U.S. PATENT DOCUMENTS 3,805,047 4/1974 Dockstader ..... 240/6.4 W
4,510,556 4/1985 Johnson ..... 362/184
5,121,310 6/1992 Ahroni ..... 362/238
5,239,450 8/1993 Wall ..... 362/104
5,347,437 9/1994 Cocia et al. ..... 362/104

*Primary Examiner*—Y. My Quach
*Attorney, Agent, or Firm*—Joseph N. Breaux

[57] ABSTRACT

An illuminated safety device including: a light array including a plurality of light emitting devices that individually emit light in a sequence; a transparent enclosure having a cavity therein containing the fight array; and a spiraled securing member in connection with the transparent enclosure in a manner to allow the securing member to support the transparent enclosure when the spiral of the securing member is positioned about a support. The spiral is preferably described by a decreasing length radius sweeping a line through at least a four-hundred-eighty (480°) degree arc.

6 Claims, 4 Drawing Sheets

ILLUMINATED SAFETY DEVICE

TECHNICAL FIELD

The present invention relates to devices securable to or carriable by an individual for calling attention to and/or making the existence of the individual known to others who may pose a possible hazard and more particularly to devices securable to or carriable by an individual for calling attention to and/or making the existence of the individual known to others who may pose a possible hazard that employ a plurality of light emitting devices as an attention attracting artifice.

BACKGROUND ART

There are numerous situations where it is desirable for an individual to attract the attention of and make known there existence to other individuals in a timely manner to avoid possible injuries. Activities such as walking, jogging and cycling often take place in the cool of the evening, along roads and highways in dark or dimly lit conditions. In addition, children running and playing during the evening hours are often injured by motorists who did not see the child in time to avoid the injury. It would be a benefit, therefore, to have a device securable or carriable by an individual that would draw attention to the individual during dark or dimly lit ambient lighting conditions. It would be a further benefit if the device were lightweight and did not interfere substantially with desirable sporting activities while being worn or carried.

GENERAL SUMMARY DISCUSSION OF INVENTION

It is thus an object of the invention to provide an illuminated safety device that includes an attachment mechanism easily securable to a variety of locations on an individual.

It is a further object of the invention to provide an illuminated safety device that includes at least two mechanism for allowing a user to secure the device to the user.

It is a still further object of the invention to provide an illuminated safety device that allows the user to select and vary the attractant illuminated display of the device.

It is a still further object Of the invention to provide an illuminated safety device that accomplishes all or some of the above objects in combination.

Accordingly, an illuminated safety device is provided that includes: a light array including a plurality of light emitting devices that individually emit light in a sequence; a transparent enclosure having a cavity therein containing the light array; and a spiraled securing member in connection with the transparent enclosure in a manner to allow the securing member to support the transparent enclosure when the spiral of the securing member is positioned about a support. The spiral is preferably described by a decreasing length radius sweeping a line through at least a four-hundred-eighty (480°) degree arc. The spiral is also preferably constructed from a resilient, flexible, light weight plastic although a substantially rigid lightweight plastic is also a desirable construction material. The spiraled nature of the securing member allows the safety device to be conveniently secured to belt loops, belts, button holes, buttons etc. In a preferred embodiment, the safety device further includes an aperture for receiving a chord, tether, or other flexible member therethrough as a second method for securing the safety device to a user.

In preferred embodiments, the light array is controlled by a user adjustable light sequencing timer circuit that allows the timing of the light emitting devices to be adjusted by the user. The adjustment is preferably accomplished with a slide switch mounted within a circuit compartment having the slide portion extending exteriorly from the circuit compartment for easy access by the user.

BRIEF DESCRIPTION OF DRAWINGS

For a further understanding of the nature and objects of the present invention, reference should be had to the following detailed description, taken in conjunction with the accompanying drawing, in which like elements are given the same or analogous reference numbers and wherein.

EXEMPLARY MODE FOR CARRYING OUT THE INVENTION

Figure 1:
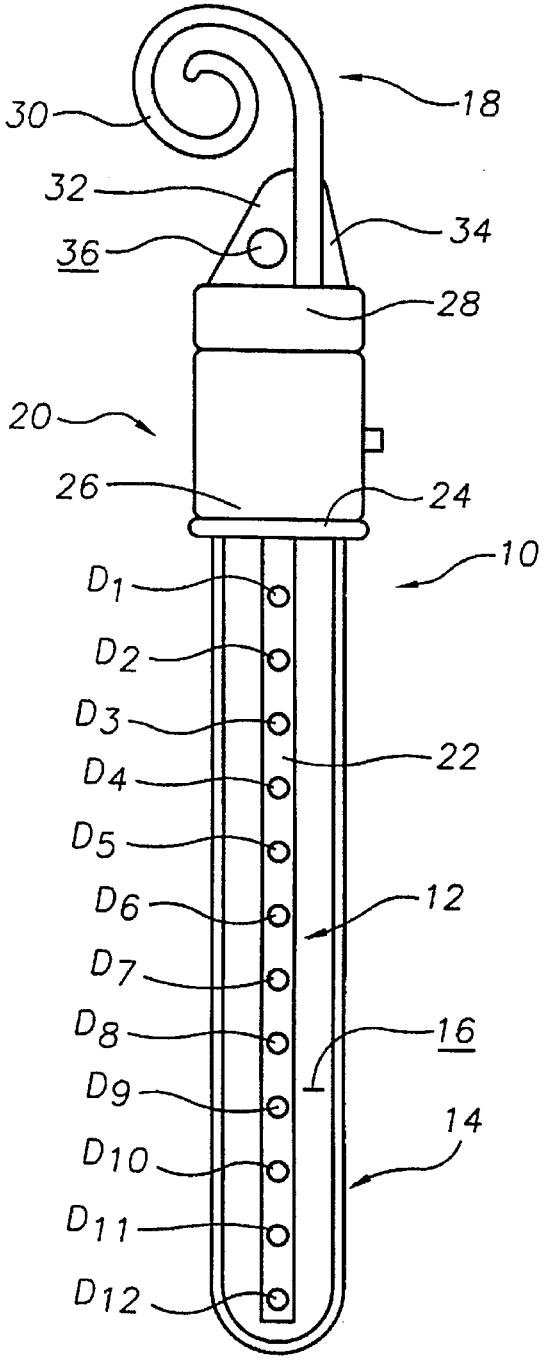
FIG. 1 is a side view of an exemplary embodiment of the illuminated safety device of the present invention showing a side view of the spiral clip member.

FIG. 1 shows an exemplary embodiment of the illuminated safety device of the present invention generally designated by the numeral 10. In this embodiment, safety device 10 includes: a light array, generally designated by the numeral 12; a transparent enclosure, generally designated by the numeral 14 and having a cavity 16 therein containing light array 12; spiraled securing member, generally designated by the numeral 18; and a timing and drive circuit (not shown in the figure) in connection with light array 12 and enclosed within a circuit casing, generally referenced by the numeral 20 that is disposed between enclosure 14 and securing member 18.

Light array 12 includes twelve (12) light emitting diodes (LED's), $D_1$–$D_{12}$, wired in a wiring harness 22. Wiring harness 22 includes thirteen wires $W_1$–$W_{13}$ (not shown in the figure) that are enclosed in a section of flexible tubing having twelve holes formed along the length thereof to allow for connection of LED's, $D_1$–$D_{12}$. The anode of each LED, $D_1$–$D_{12}$ is connected individually to one each of wires $W_1$–$W_{12}$, and one wire $W_{13}$ is commonly connected to all the cathodes of LED's, $D_1$–$D_{12}$.

Transparent enclosure 14 is test tube shaped and constructed from clear plastic. Light array 12 is disposed within cavity 16 which is of a length about equal to the length of wiring harness 22. An open end 24 of enclosure 14 is secured in connection with one end 26 of circuit casing 20 with glue.

In this embodiment, securing member 18 is integrally formed with a cap portion 28 of circuit casing 20 and includes a spiral connecting end 30, a first stabilizer 32, and a second stabilizer 34. Stabilizer 32 has a chord or tether receiving aperture 36 formed therethrough to provide additional means for securing safety device 10 to a user if desired. Spiral connecting end 30 is flexible and resiliently returns to its original spiral configuration when any deforming force is removed. In this embodiment, spiral connecting end 30 is described by a decreasing length radius sweeping a line through a four-hundred-eighty (480°) degree arc.

Figure 2:
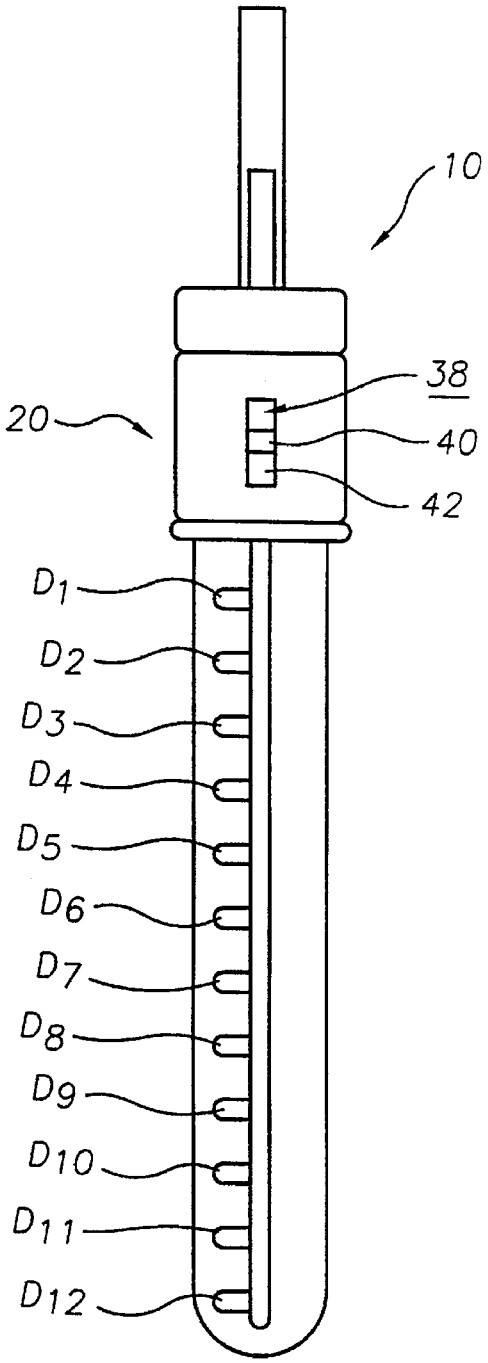
FIG. 2 is a second side view of the embodiment of the illuminated safety device of FIG. 1.
Figure 3:
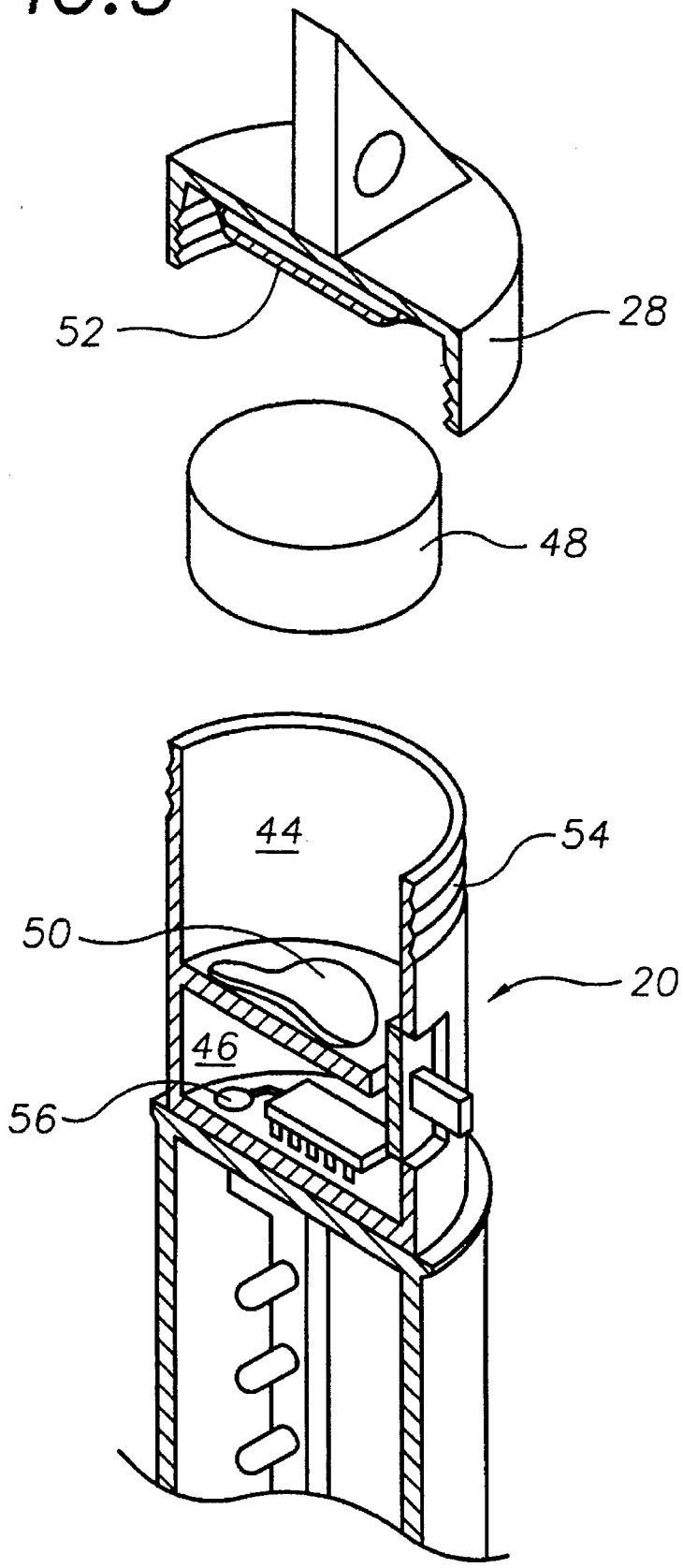
FIG. 3 is a cross-sectional, exploded view of the circuit casing of the safety device of FIG. 1 showing the battery and the circuit compartments.

FIG. 2 is a second side view of the safety device 10 shown in FIG. 1 showing LED's, $D_1$–$D_{12}$, and a slide switch aperture 38 running along the side of circuit casing 20 with a positioning tab 40 of a slide switch 42 extending outward therefrom. As shown in FIG. 3, circuit casing 20 has a battery compartment 44 and a circuit compartment 46 formed therein. In this embodiment, battery compartment 44 is sized to receive a watch or calculator type battery 48 and includes a first battery contact 50. A second battery contact 52 is secured within cap portion 28. Cap portion 28 is internally, and companionately threaded with the external peripheral edge 54 of circuit casing 20 to allow for replacement of battery 48 when required. Circuit compartment 46 is sized to contain the timing and drive circuit (shown schematically in FIG. 4 and discussed in more detail hereinafter below) and has a wiring aperture 56 through which wires $W_1W_{13}$ (shown schematically in FIG. 4) pass.

Figure 4:
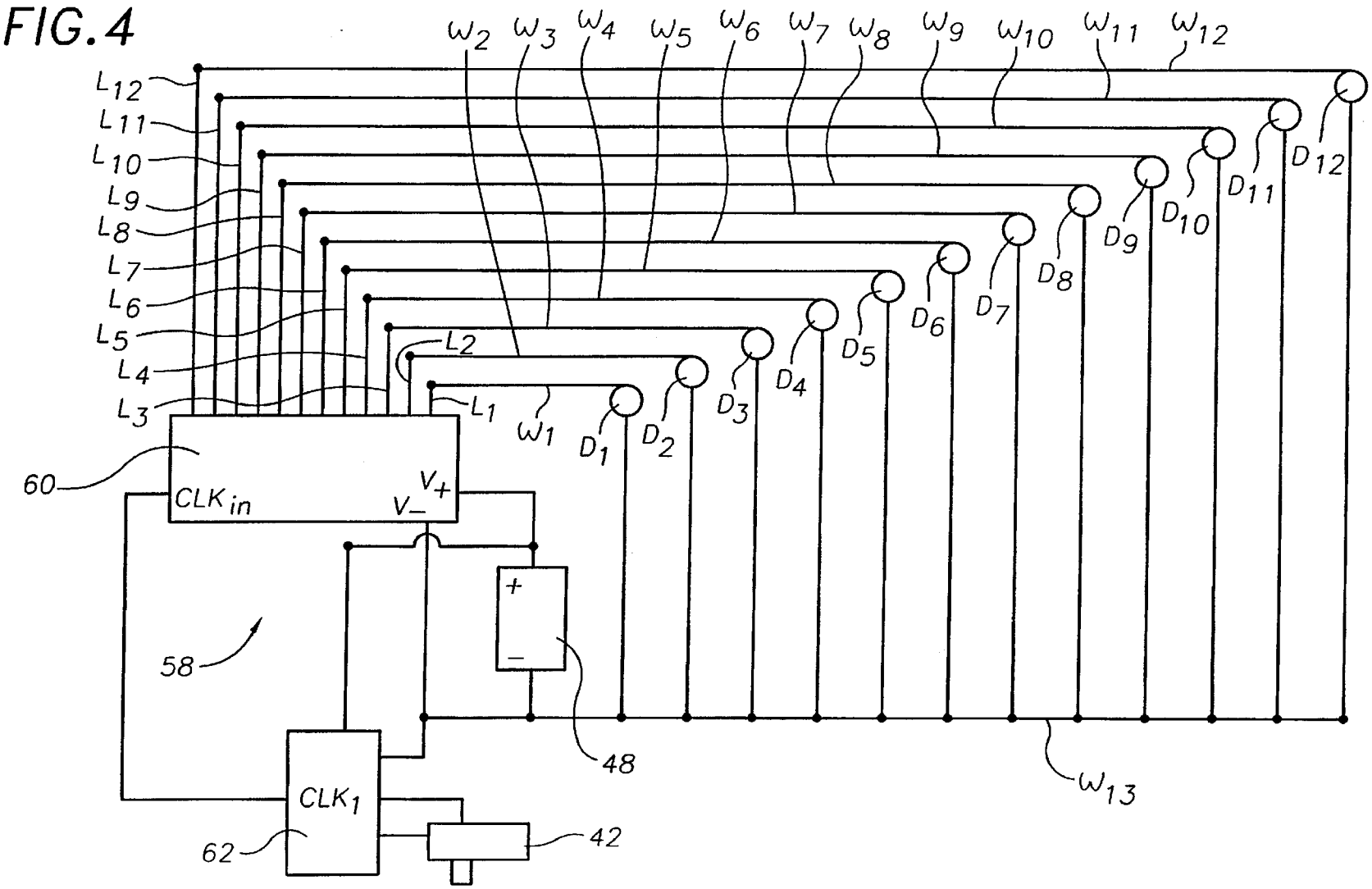
FIG. 4 is a schematic diagram of the timing and drive circuit of the embodiment of the safety device of FIG. 1.
Figure 5:
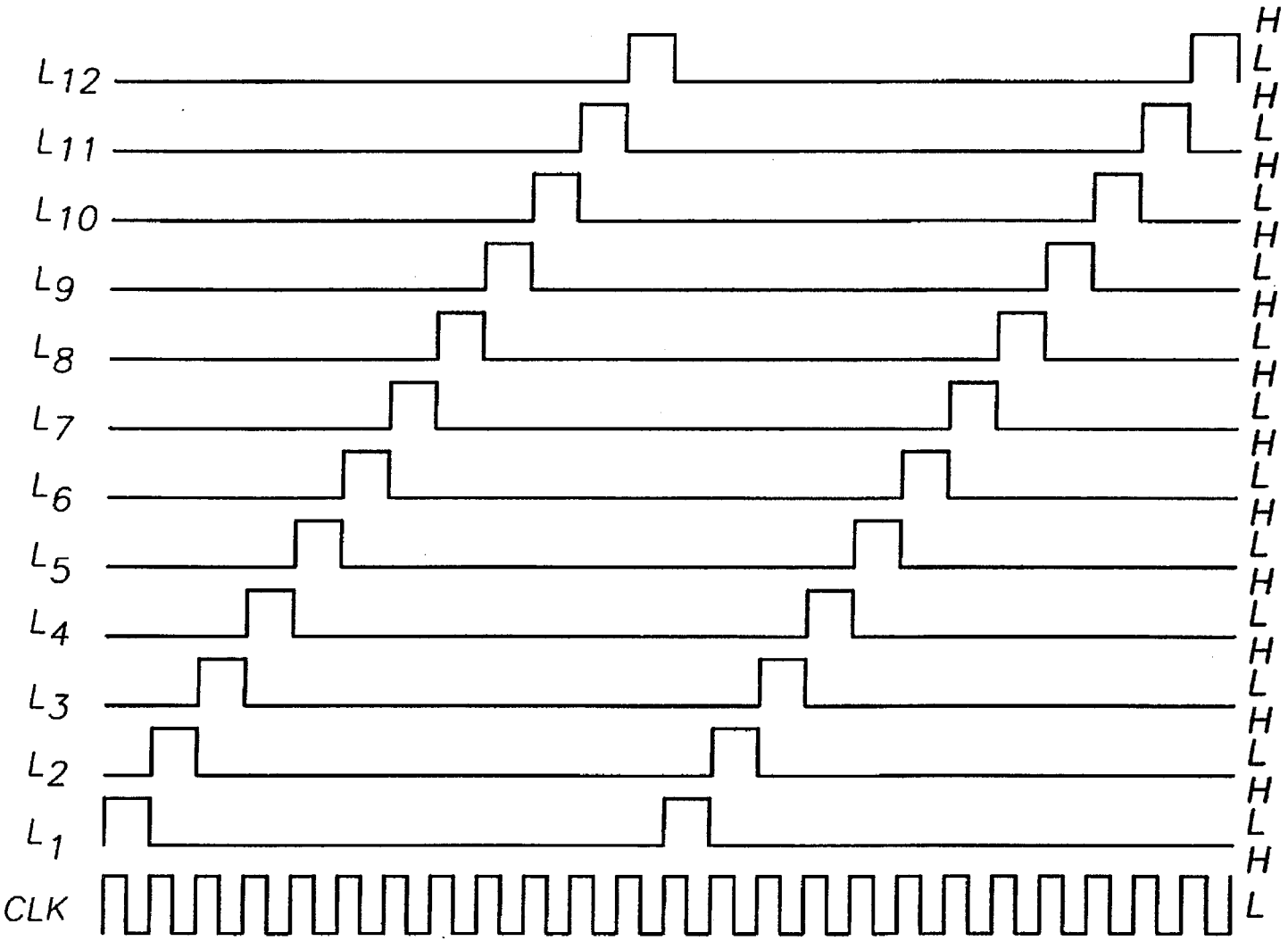
FIG. 5 is a timing diagram showing the outputs of the ring counter of the timing and drive circuit in response to an input clock signal.

FIG. 4 is a schematic diagram of the timing and drive circuit used in this embodiment, generally designated by the numeral 58. Circuit 58 includes a ring counter 60 having twelve output lines, $L_1$–$L_{12}$, and a variable output frequency clock signal generator 62 having a variable resistance slide switch 42 wired therein in a manner to allow the position of the slide switch to vary the output frequency of a clock signal output, $CLK_1$, of signal generator 62. $CLK_1$ is wired to a $CLK_{in}$ input line of ring counter 60. The state of two of the twelve output lines, $L_1$–$L_{12}$, of ring counter 60 change on the transition of $CLK_{in}$ from a low voltage state to a high voltage state as shown in the timing diagram of FIG. 5. The anode of each LED, $D_1$–$D_{12}$, is connected to its respective output line, $L_1$–$L_{12}$, of ring counter 60 via wires, $W_1$–$W_{12}$. Only the LED, $D_1$–$D_{12}$, that is connected to the output line, $L_1$–$L_{12}$, currently at the high state is illuminated.

Use of safety device 10 is simple. Safety device 10 is turned on by sliding positioning tab 40 along slide switch aperture 38 until light array 12 is functioning at the desired lighting frequency and then securing the safety device 10 to the user by coiling flexible, spiral connecting end 30 about any available support structure such as a belt loop, belt, or button hole and button combination. All twelve LED's, $D_1$–$D_{12}$, can be made to appear to be simultaneously illuminated by increasing the frequency to a frequency at which each LED is lighted at least 30 times a second. Thus both a chaser type display and a fully illuminated display may be selected by a user.

It can be seen from the preceding description that an illuminated safety device has been provided that includes an attachment mechanism easily securable to a variety of locations on an individual; that includes at least two mechanisms for allowing a user to secure the device to the user; and that allows the user to select and vary the attractant illuminated display of the safety device.

It is noted that the embodiment of the illuminated safety device described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An illuminated safety device comprising:

a light array including a plurality of light emitting devices wired in a wiring harness including a length of flexible tubing having a number of apertures formed along the length thereof corresponding to a number of light emitting devices and receiving said light emitting device;

a transparent enclosure having a cavity therein containing said light array;

a timing and drive circuit in connection with said light array;

a circuit casing member in connection with said enclosure and having a chamber therein containing at least a portion of said timing and drive circuit; and a spiraled securing member in connection with said circuit casing member in a manner to allow said securing member to support said enclosure;

said spiral securing member including a connecting end described by a decreasing length radius sweeping a line through at least a four-hundred-eighty degree arc.

2. The illuminated safety device of claim 1 wherein:

said circuit casing member includes a cap portion, and said securing member is integrally formed with said cap portion and includes a stabilizer portion having a receiving aperture formed therethrough of a size sufficient to allow a flexible member to pass therethrough.

3. The illuminated safety device of claim 1 wherein:

said circuit casing member includes an elongated aperture running along a side of circuit casing member; and said timing and drive circuit includes a variable resistance member having a positioning tab extending outward from said elongated aperture.

4. The illuminated safety device of claim 3 wherein:

said chamber of said circuit casing member includes a compartment formed therein having a defining wall, a wiring aperture formed through said defining wall of said circuit casing member through which an electrical connection is formed between said timing and drive circuit and said light array.

5. An illuminated safety device comprising:

a light array;

a transparent enclosure having a cavity therein containing said light array;

a timing and drive circuit in connection with said light array;

a circuit casing member in connection with said enclosure and having a chamber therein containing at least a portion of said timing and drive circuit; and a spiraled securing member in connection with said circuit casing member in a manner to allow said securing member to support said enclosure;

said spiral securing member including a connecting end described by a decreasing length radius sweeping a line through at least a four-hundred-eighty degree arc;

said chamber of said circuit casing member including a compartment formed therein having a wiring aperture formed through a defining wall of said compartment through which an electrical connection is formed between said timing and drive circuit and said light array;

said light array includes a plurality of light emitting devices wired in a wiring harness including a length of flexible tubing having a number of apertures formed along the length thereof corresponding to a number of light emitting devices and receiving said light emitting devices.

6. The illuminated safety device of claim 5 wherein:

said transparent enclosure is test tube shaped including a first open end in connection with said cavity in said enclosure of a length about equal to a length of said light array, said open end being secured in connection pith said circuit casing member.

* * * * *